US009339064B2

(12) United States Patent
Oliver

(10) Patent No.: US 9,339,064 B2
(45) Date of Patent: May 17, 2016

(54) SWEATSHIRT PIPE

(71) Applicant: Sean Oliver, Santa Cruz, CA (US)

(72) Inventor: Sean Oliver, Santa Cruz, CA (US)

( * ) Notice: Subject to any disclaimer, the term of this patent is extended or adjusted under 35 U.S.C. 154(b) by 226 days.

(21) Appl. No.: 13/986,240

(22) Filed: Apr. 15, 2013

(65) Prior Publication Data

US 2014/0304885 A1 Oct. 16, 2014

(51) Int. Cl.
*A41D 1/00* (2006.01)
*A41D 1/04* (2006.01)

(52) U.S. Cl.
CPC ..... *A41D 1/04* (2013.01); *A41D 2200/20* (2013.01)

(58) Field of Classification Search
CPC ..... A41D 1/002; A41D 1/04; A41D 31/0022
USPC ..... 131/178, 191–192, 225; 2/84, 90, 250
See application file for complete search history.

(56) References Cited

U.S. PATENT DOCUMENTS

| | | | | |
|---|---|---|---|---|
| 1,727,763 | A * | 9/1929 | Gevirman | 131/328 |
| 2,078,844 | A * | 4/1937 | Gardian | 131/186 |
| 4,094,508 | A * | 6/1978 | Kirsch | 273/118 R |
| 4,243,058 | A * | 1/1981 | Gershbein | 131/330 |
| 5,685,015 | A * | 11/1997 | Aldridge | 2/81 |
| 7,519,192 | B1 * | 4/2009 | Laycock et al. | 381/301 |
| 2007/0094763 | A1 * | 5/2007 | Silver | 2/69 |
| 2009/0019624 | A1 * | 1/2009 | Birk et al. | 2/455 |
| 2009/0288670 | A1 * | 11/2009 | Lee et al. | 131/330 |
| 2012/0045084 | A1 * | 2/2012 | Groset et al. | 381/384 |
| 2014/0053854 | A1 * | 2/2014 | Barry, Jr. | 131/178 |
| 2015/0196061 | A1 * | 7/2015 | Oliver | A24F 47/008 2/84 |
| 2016/0015104 | A1 * | 1/2016 | Edwards | A41D 27/20 2/94 |

OTHER PUBLICATIONS

Fleece Sweatshirt, Nomex IIIA. Bulwark Web. Feb. 13, 2015. Retrieved Nov. 16, 2011. http://www.bulwark.com/p-225-fleece-sweatshirt-nomex-iiia-navy.aspx.*

FR Nomex Jackets. Bulwark Web. Feb. 19, 2015. Retrieved Nov. 29, 2011. http://www.bulwarkonline.com/c-30-fr-nomex-jeackets.aspx.*

'Genius product? Crazy genius? Or just crazy?' Technology in Music Education Web. Aug. 17, 2015. Retrieved from Jan. 17, 2011. https://techinmusiced.wordpress.com/2011/01/17/genius-product-crazy-genius-or-just-crazy/.*

'Shhmokewear Neck Hookah!' YouTube Video Web. Aug. 18, 2015. Retrieved from Dec. 1, 2011. www.youtube.com/watch?v=omycNzb6FgQ.*

* cited by examiner

*Primary Examiner* — Clinton T Ostrup
*Assistant Examiner* — Anne Kozak
(74) *Attorney, Agent, or Firm* — Haverstock & Owens LLP

(57) ABSTRACT

A sweatshirt having a smoking apparatus as part of the sweatshirt, allowing users to smoke out of the sweatshirt comprises a garment body having a neck opening and sleeves and an elongated cord for tightening the sweatshirt hood around the users head and neck. A hollow tube is positioned inside of the elongated cord. The elongated tube has a first end and a second end with the first end having a mouthpiece, and the second end having a smoking bowl piece for retaining smoking material.

16 Claims, 3 Drawing Sheets

SWEATSHIRT PIPE

BACKGROUND OF THE INVENTION

1. Technical Field

This invention relates generally to garments, and more particularly to a hooded garment such as a sweatshirt having a smoking apparatus as a part of the clothing, allowing a user to smoke out of their clothes.

2. Background Art

Various types of clothing have been proposed and implemented which use cords or strings to close a portion thereof. Well known examples are sweatshirts, hooded sweatshirts, sweaters, jackets and pants. Although a wide variety of such clothing has been proposed and implemented for normal wear and use as well as for sport and recreational purposes, the present invention provides a novel and unique sweatshirt which may be used both as a sweatshirt and a smoking apparatus. Although prior sweatshirts have been adapted and used for various purposes, there have not been developments in the sweatshirt field that allow a user to use the sweatshirt to safely smoke for either pleasure or medicinal purposes. Accordingly, the present invention shares very little with existing sweatshirts, and has a completely different utility and effect.

Since the advent of human history, humans have worn various types of clothing to protect themselves from the elements. Some of these clothing have been directed to a cold weather climate, while others to warmer conditions, and others to moderated or intermediate temperature conditions.

It is well known in the art that many types of cool or cold weather apparel exist for protecting a wearer's body, especially, the upper torso, including coats, sweaters, sweatshirts, and other related outerwear. In many cases, different items of apparel may be worn together, such as a coat and a hat to improve the overall protection and utility for the wearer. Similarly, certain apparel may combine features such as a coat liner or removable hood, to increase the circumstances in which the apparel might be appropriately used.

In addition to separate apparel, in some designs, outerwear may include combinations of protective elements in an integrated design. For example, some coats, jackets, sweatshirts, and sweaters, include a hood which is integrally formed or is removable. This allows the user to cover the head and neck when exposed to the elements and lower or remove the hood when not needed.

The present invention, provides, for the first time, a sweatshirt which may be hooded or not, which has a smoking apparatus as an integral part thereof. The sweatshirt of the present invention allows a user to safely and conveniently smoke without the need of a separate device or apparatus. This is something that a conventional sweatshirt is unable to do, but is done with ease on the sweatshirt of the present invention.

The sweatshirt of the present invention also possesses the ability to allow users to smoke easily and safely in an article of clothing being worn by the user and is configured to be highly adaptable to any style, type or design of sweatshirt.

The present invention provides a unique smoking sweatshirt that is both comfortable, utilitarian, and practical. The applicant is not aware of any other sweatshirt construction or design that so allows a user to smoke directly from the sweatshirt while being worn by the user.

Accordingly, the primary object of the present invention is to provide a smoking sweatshirt which may be used and worn like a conventional sweatshirt, but which has a smoking apparatus integral therewith, allowing the wearer enjoy a smoke while wearing the sweatshirt. The sweatshirt of the present invention is easily adapted for use, is easy to learn how to use, is very reliable, safe, and is very efficient in operation.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF SUMMARY OF THE INVENTION

To achieve the foregoing objects, and in accordance with the purpose of the invention as embodied and broadly described herein, a sweatshirt pipe having a smoking apparatus integral with and as part of the sweatshirt, allows users to smoke out of the sweatshirt, comprises a garment body having a neck opening and sleeves and an elongated cord for tightening the sweatshirt hood around the users head and neck. A hollow tube is positioned inside of the elongated cord. The elongated tube has a first end and a second end with the first end having a mouthpiece, and the second end having a smoking bowl for retaining smoking material. In various embodiments the sweatshirt may be hooded or not, designed with any choice of color, and made in any style or design. The elongated cord may be string composed of cloth, cord, or other tubing, which functions both as a smoke conduit and a tightening element of the sweatshirt. The mouthpiece may be provided in various configurations and designs and is constructed of a heat resistant material. The smoking bowl may be provided in various configurations and designs and is composed of a heat resistant material. The elongated tube is secured to the mouthpiece and to the smoking bowl by a bonding agent, such as adhesives, glue, tape sealant, or the like. The sweatshirt, garment body, neck opening and sleeves, and hood, if provided, are preferably composed of a heat resistant, fireproof material capable of withstanding high temperatures. Accordingly, the present invention provides a sweatshirt pipe, which functions both as a sweatshirt and a smoking apparatus.

BRIEF DESCRIPTION OF THE DRAWINGS

The accompanying drawings, which are incorporated in and constitute a part of the specification, illustrate a preferred embodiment of the invention and, together with a general description given above and the detailed description of the preferred embodiment given below, serve to explain the principles of the invention.

DETAILED DESCRIPTION OF THE INVENTION

Figure 3:
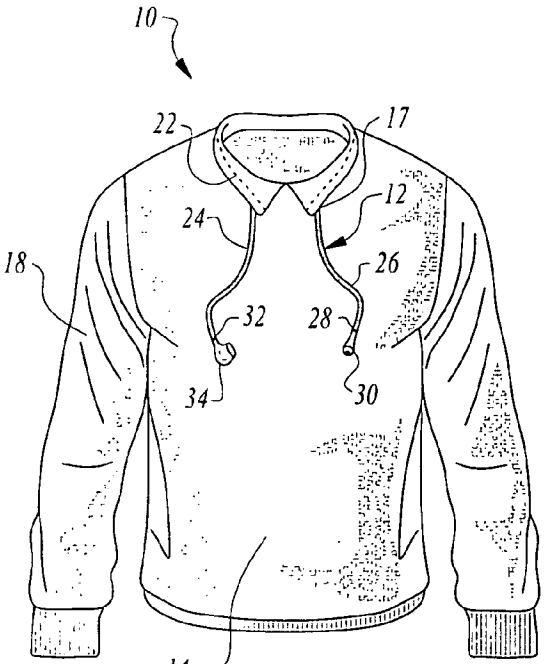
FIG. 3, shows a sweatshirt without a hood having a smoking apparatus as part of the sweatshirt, allowing users to smoke out of the sweatshirt, according to the invention.

Reference will now be made in detail to the present preferred embodiments of the invention as illustrated in the accompanying drawings.

In accordance with the present invention, there is provided in a preferred embodiment of the invention, a sweatshirt having a smoking apparatus as part of the sweatshirt, allowing users to smoke out of the sweatshirt. The sweatshirt comprises a garment body having a neck opening and sleeves and an elongated cord for tightening the sweatshirt hood or neck around the users head and neck. A hollow tube is positioned inside of the elongated cord. Preferably the elongated tube has a first end and a second end with the first end having a mouthpiece, and the second end having a smoking bowl for retaining smoking material In FIG. 1, a preferred embodiment of a hooded sweatshirt 10, having a smoking apparatus 12, is shown, comprising, a garment body 14, having a neck opening 16, and sleeves 18. A hood 20, adapted to be worn over a user's head, is preferably attached by hood stitching 22, to the garment body 14. Hood 20, preferably has an elongated cord or drawstring 24, positioned in aperture 19, for tightening the sweatshirt hood 20, around the users head and neck. A hollow tube 26, is positioned inside of elongated cord 24. The hollow tube 26, has a first end 28, and a second end 32. The first end having a mouthpiece 30, and the second end having a smoking bowl piece 34, for retaining smoking material, such as tobacco. A front pocket 21, may be provided for the sweatshirt, as is well known in the art.

Figure 2:
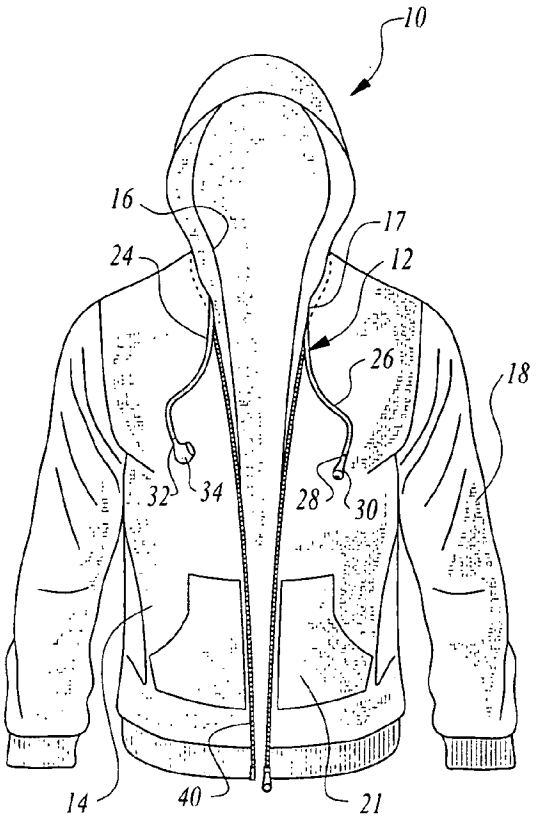
FIG. 2, shows zippered sweatshirt pipe having a smoking apparatus as part of the sweatshirt, allowing users to smoke out of the sweatshirt, according to the invention.
Figure 1:
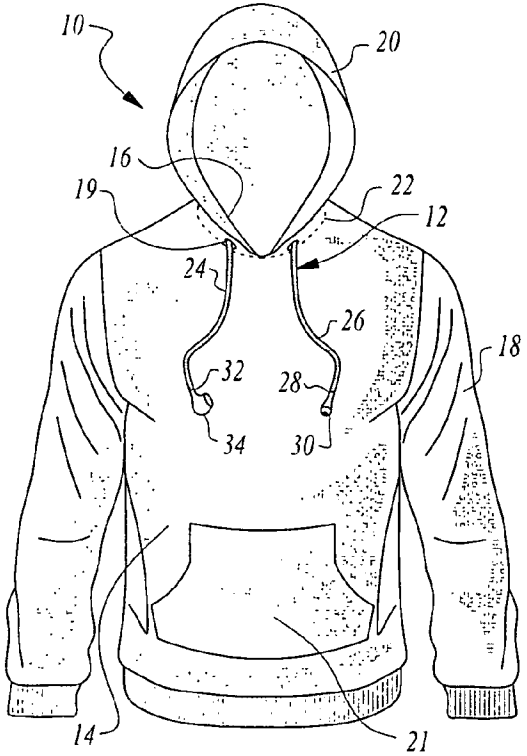
FIG. 1, shows a sweatshirt pipe having a smoking apparatus as part of the sweatshirt, allowing users to smoke out of the sweatshirt, according to the invention.

The sweatshirt 10, which may be hooded, as seen in FIGS. 1-2, has an elongated tube 26, positioned inside elongated cord or drawstring 24, which preferably is a string or drawstring composed of cloth or fibers of different materials including cotton, polyester, cotton-poly blends, fiberglass, carbon fiber, aramid, and the like, the criteria being that the material is fire resistant and fireproof.

The hollow tube 26, is preferably elongated and is composed of high temperature tubing which is covered by cord or drawstring 24. Tube 26, may be inserted into covering cord or drawstring 24, or can be pre-made with the covering. Tube 26, can be made of silicone, PVC, Tygon and other high temperature tubing well known in the art. Tubing 26, is secured at first end 28, to mouthpiece 30, by a bonding agent or other attachment mechanism, and at second end 32, to smoking bowl piece 34, by bonding agents or other attachment mechanisms. Tube 26, and covering 24, may be held in place by tube stitching 17, running the perimeter of hood 20.

Smoking bowl piece 34, is composed of a durable heat resistant, strong and shatter resistant material, such as glass, metal, wood, clay, bone, or other high temperature resilient materials. Smoking bowl piece 34, may be shaped in many different shapes, which are for the purpose of containing tobacco or other smoking material. Smoking bowl 34, can be shaped to look like a normal part of sweatshirt 10, or can be shaped to be noticed and extravagant.

Mouthpiece 30, can be made of the same materials as smoking bowl piece 34, The mouthpiece is constructed of a heat resistant material such as glass, metal, wood, clay, bone, or other high temperature resilient material, and can be made to match the appearance of smoking bowl piece 34, or otherwise. Both mouthpiece 30, and smoking bowl piece 34, can be provided in a wide variety of designs and colors.

Sweatshirt 10, may be hooded as shown in FIGS. 1-2, or provided without a hood as seen in FIG. 3. Sweatshirt 10, garment body 14, sleeves 18, and hood 20, are preferably composed of a heat resistant, fireproof material capable of withstanding high temperatures. This is also the case with the coat embodiment shown in FIG. 4, or any other article of clothing in which the present invention may be implemented, particularly those which use cords or drawstrings to tighten a part of the clothing to a part of the user's body.

With reference now to FIG. 2, a hooded sweatshirt similar to that seen in FIG. 1, is shown, except that in FIG. 2, sweatshirt 10 has a zipper 40. In FIG. 2, smoking apparatus 12, is shown, along with a garment body 14, having a neck opening 16, and sleeves 18. A hood 20, adapted to be worn over a user's head, is preferably attached by stitching 22, to the garment body 14. Hood 20, preferably has an elongated cord or drawstring 24, for tightening the sweatshirt hood 20, around the users head and neck. A hollow tube 26, is positioned inside of elongated cord 24. The hollow tube 26, has a first end 28, and a second end 32. The first end having a mouthpiece 30, and the second end having a smoking bowl piece 34, for retaining smoking material, such as tobacco.

In FIG. 3, a sweatshirt 10, similar to that seen in FIG. 1, is shown, except without a hood. In FIG. 3, smoking apparatus 12, is shown integral with sweatshirt 10. Sweatshirt 10, having a garment body 14, having a neck opening 16, and sleeves 18. Smoking apparatus 12, preferably comprises hollow tube 26, positioned inside of elongated cord 24. The hollow tube 26, has a first end 28, and a second end 32. The first end having a mouthpiece 30, and the second end having a smoking bowl piece 34, for retaining smoking material, such as tobacco. Stitches 17, are seen In FIG. 3, holding smoking apparatus 12, positioned in place, functioning both as a smoking apparatus and a drawstring for the sweatshirt.

Figure 4:
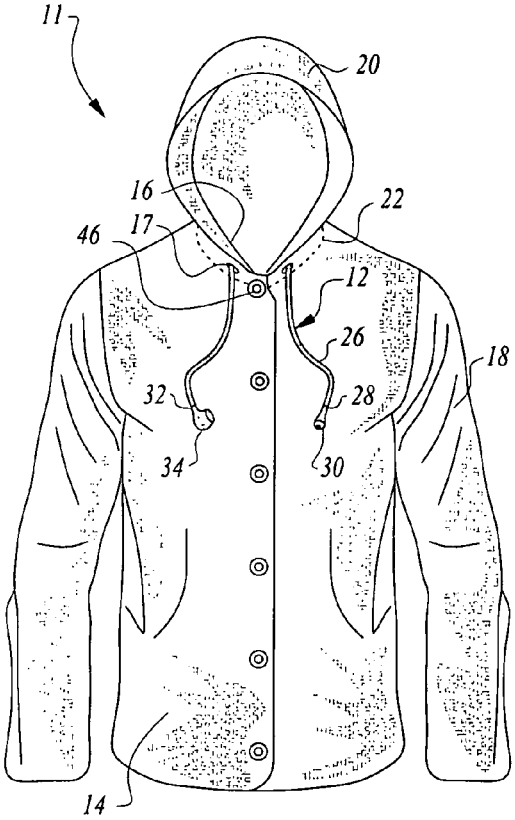
FIG. 4, shows a winter style coat with the sweatshirt pipe as part of the coat, allowing users to smoke out of the coat, according to the invention.

In FIG. 4, another embodiment of smoking sweatshirt 10, is shown, here in a style as a winter coat 11, with buttons, clasps, or snaps, 46, for securely closing and buttoning the coat. In FIG. 4, smoking apparatus 12, is shown, with the coat having a garment body 14, having a neck opening 16, and sleeves 18. A hood 20, adapted to be worn over a user's head, is preferably attached by stitching 22, to the garment body 14. Hood 20, preferably has an elongated cord or drawstring 24, for tightening the sweatshirt hood 20, around the users head and neck. A hollow tube 26, is positioned inside of elongated cord 24. The hollow tube 26, has a first end 28, and a second end 32. The first end having a mouthpiece 30, and the second end having a smoking bowl piece 34, for retaining smoking material, such as tobacco.

Figure 5:
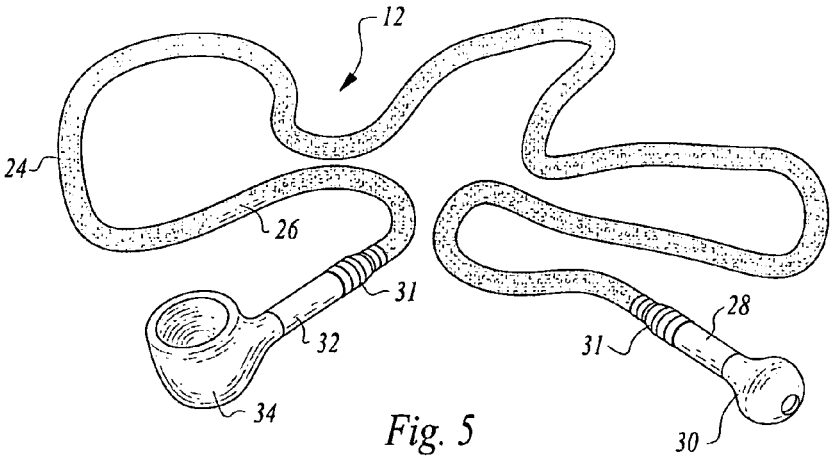
FIG. 5, shows an elongated cord or covered tubing which functions as both a drawstring for the sweatshirt and a smoking device, according to the invention.
Figure 13:
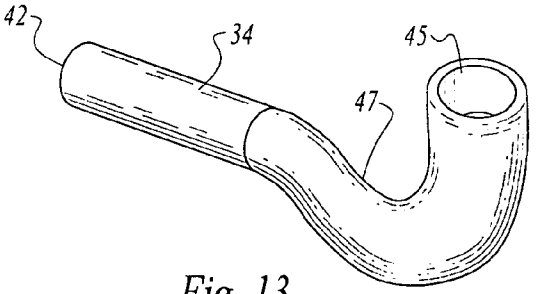
FIG. 13, shows another preferred bowl shape for the smoking apparatus, according to the invention.
Figure 12:
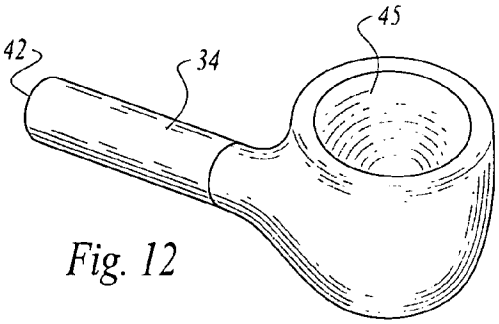
FIG. 12, shows another preferred bowl shape for the smoking apparatus, according to the invention.
Figure 11:
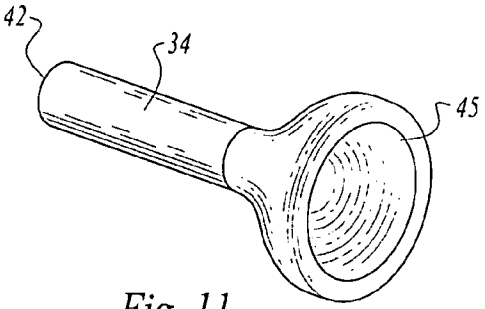
FIG. 11, shows a preferred bowl shape for the smoking apparatus, according to the invention.

With reference now to FIG. 5, smoking apparatus 12, comprising elongated cord or drawstring 24. hollow tube 26, mouthpiece 30, and smoking bowl piece 34, are shown taken out of sweatshirt 10, to illustrate more clearly the apparatus. Smoking apparatus 12, is preferably constructed by positioning tube 26, within cord or drawstring 24. As discussed above, cord or drawstring 24, is preferably an elongated cord, sting, or drawstring, composed of heat resistant cloth or fibers of different materials including cotton, polyester, cotton-poly blends, fiberglass, carbon fiber, aramid, and the like. The hollow tube 26, is preferably elongated and is composed of high temperature resistant and non-flammable tubing which is covered by the cord or drawstring 24. Tube 26, may be inserted into covering cord or drawstring 24, or can be premade with the covering. Tube 26, can be made of silicone, PVC, Tygon and other high temperature tubing well known in the art. Tubing 26, is secured at first end 28, to mouthpiece 30, by a bonding agent or other attachment mechanism, and at second end 32 to smoking bowl piece 34, by bonding agents or other attachment mechanisms. Tube 26 and covering 24, may be held in place by stitching 17, running the perimeter of hood 20, seen in FIGS. 1 and 3. In FIG. 5, smoking bowl piece 34, is seen secured to second end 32 of tube 26, and is preferably composed of a durable heat resistant, strong and shatter resistant material, such as glass, metal, wood, clay, bone, or other high temperature resilient materials. Smoking bowl piece 34, may be shaped in many different shapes, as seen in FIGS. 11-13 which are for the purpose of containing tobacco or other smoking material. Smoking bowl piece 34, can be shaped to look like a normal part of sweatshirt 10, or coat 11, or can be shaped to be noticed and extravagant. In FIG. 5, mouthpiece 30, can be made of the same materials as smoking bowl 34, The mouthpiece is constructed of a heat resistant material such as glass, metal, wood, clay, bone, or other high temperature resilient materials, and can be made to match the appearance of smoking bowl piece 34, or otherwise. Both mouthpiece 30, and smoking bowl piece 34, can be provided in a wide variety of designs and colors. In FIG. 5, both mouthpiece 30, and smoking bowl 34, are positioned and secured with a tape, such as silicone tape 31, but may be otherwise secured as discussed in relation to FIGS. 6-8.

Figure 6:
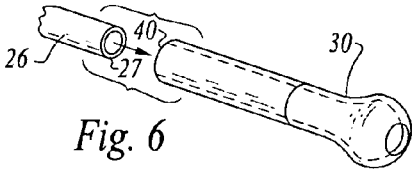
FIG. 6, shows a preferred connection of the covered tubing with a smoking mouthpiece or bowl, where the tubing is smaller than the mouthpiece, according to the invention.
Figure 7:
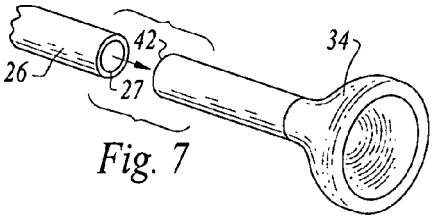
FIG. 7, shows another a preferred connection of the covered tubing with a smoking mouthpiece or bowl where the tubing is the same size as the mouthpiece, according to the invention.
Figure 8:
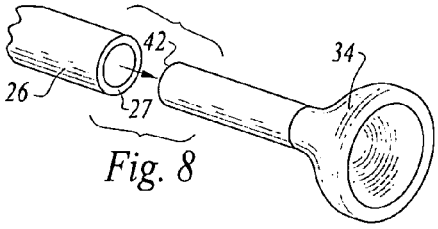
FIG. 8, shows another a preferred connection of the covered tubing with a smoking mouthpiece or bowl where the tubing is larger in size than the mouthpiece, according to the invention.

In FIGS. 6-8 different preferred embodiments of ways to connect tube 26, with either mouthpiece 30 or smoking bowl piece 34, are shown. In FIGS. 6-8 tubing 26 is shown in various configurations to connect with either smoking bowl piece 34, or mouthpiece 30, however, the exact same variations may be used with the smoking bowl piece 34, or the mouthpiece 30.

In FIG. 6, in a preferred embodiment opening 27, in tubing 26, is configured to be smaller than opening 40, in mouthpiece 30, and can be fit into opening 40, and then sealed using tape, adhesives, mechanical means, or sealants. For example, silicone tape, adhesives, heat shrinking tubing strips, metal wire wraps or any other technique which is secure and creates an aesthetically appealing look may be used to secure the tubing to the mouthpiece 30 or smoking bowl piece 34. This also creates a place for the user to hold the mouthpiece or smoking bowl piece in a way which defers heat to their fingers.

In FIG. 7, in another preferred embodiment of the invention opening 27, in tubing 26, is configured to be the same size as opening 42, in smoking bowl 34, and can be fit onto opening 42, and then sealed using tape, adhesives, mechanical means, or sealants. For example, silicone tape, adhesives, heat shrinking tubing strips, metal wire wraps or any other technique which is secure and creates an aesthetically appealing look may be used to secure the tubing to the smoking bowl 34, or mouthpiece 30.

In FIG. 8, in another preferred embodiment of the invention opening 27, in tubing 26, is configured to be the larger in size as opening 42, in smoking bowl piece 34, and can be fit over opening 42, and then sealed using tape, adhesives, mechanical means, or sealants. For example, silicone tape, adhesives, heat shrinking tubing strips, metal wire wraps or any other technique which is secure and creates an aesthetically appealing look may be used to secure the tubing to the smoking bowl 34, or mouthpiece 30.

Figure 9:
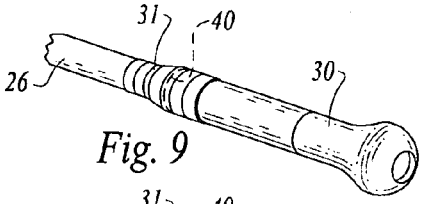
FIG. 9, shows a preferred way to seal the tubing to the mouthpiece or bowl using silicone tape, according to the invention.
Figure 10:
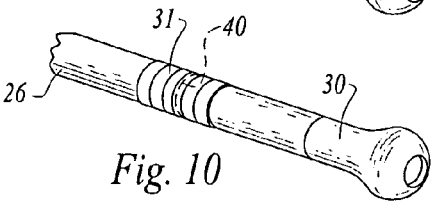
FIG. 10, shows another preferred way to seal the tubing to the mouthpiece or bowl where the tips of both the tubing and the mouthpiece or bowl are glued together, according to the invention.

In FIGS. 9 and 10, different methods of sealing tubing 26 at either the mouthpiece 30, or smoking bowl piece 34, are shown. In FIGS. 9 and 10, the different methods are illustrated using the mouthpiece 30, however, the exact same methods may be used with the smoking bowl piece 34, as well.

With reference to FIG. 9, silicone tape 31, is used to seal tubing 26, to mouthpiece 30. In FIG. 9 tube 26, is configured smaller than opening or aperture 40, in mouthpiece 30, and silicone tape is wrapped around both. Other sealants may also be used, such as adhesives, for example, gluing tube 26, to the mouthpieces, or using heat shrink tubing strips, metal wire, or other fastening techniques well known in the art, to make an airtight seal.

In FIG. 10, another preferred method of sealing tubing 26, to either mouthpiece 30, or smoking bowl piece 34, is shown. With reference to FIG. 10, silicone tape 31, is used to seal tubing 26, to mouthpiece 30. In FIG. 10, tube 26, is configured the same size as the opening or aperture 40, in mouthpiece 30, and silicone tape is wrapped around both. However, other sealants may also be used, such as adhesives, for example, gluing tube 26, to the mouthpieces, or using heat shrink tubing strips, metal wire, or other fastening techniques well known in the art.

In FIGS. 11-13 different configurations of smoking bowl piece 34, are illustrated. It is clear that a wide variety of other smoking bowl piece configurations may be used and implemented and the configurations shown in FIGS. 11-13 are for example only.

With reference to FIG. 11, smoking bowl piece 34, with aperture 42, is shown with smoking bowl 45, positioned essentially in an upright orientation.

With reference to FIG. 12, smoking bowl piece 34, with aperture 42, is shown with smoking bowl 45, positioned essentially in an essentially horizontal orientation.

With reference to FIG. 13, smoking bowl piece 34, having a curved portion 47, with aperture 42, and is shown with smoking bowl 45, positioned in an essentially horizontal orientation.

Figure 16:
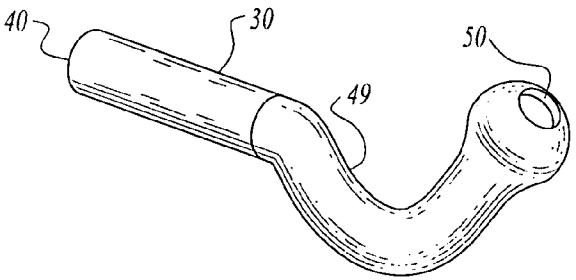
FIG. 16, shows another preferred mouthpiece shape for the smoking apparatus, according to the invention.
Figure 15:
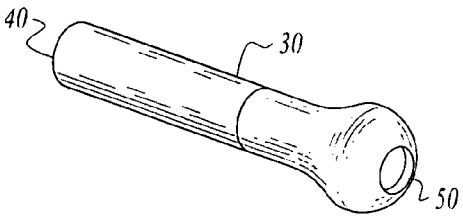
FIG. 15, shows another preferred mouthpiece shape for the smoking apparatus, according to the invention.
Figure 14:
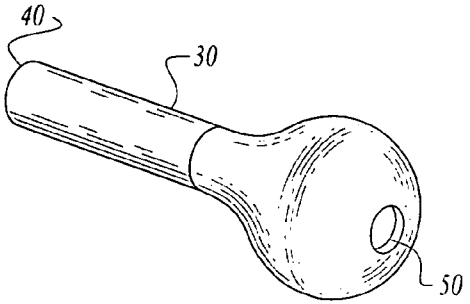
FIG. 14, shows a preferred mouthpiece shape for the smoking apparatus, according to the invention.

In FIGS. 14-16, different configurations of mouthpiece 30, are illustrated. It is clear that a wide variety of other mouthpiece configurations may be used and implemented and the configurations shown in FIGS. 14-16 are for example only.

With reference to FIG. 14, mouthpiece 30, with opening or aperture 40, is shown with inhalation opening 50, positioned essentially in an upright orientation.

With reference to FIG. 15, mouthpiece 30, with opening or aperture 40, is shown with inhalation opening 50, positioned in an essentially horizontal orientation.

With reference to FIG. 13, smoking bowl piece 34, having a curved portion 47, with opening or aperture 42, and is shown with smoking bowl 45, positioned in an essentially horizontal orientation.

In operation and use, the present invention provides a sweatshirt pipe 10, which is a novel new type of clothing. Sweatshirt pipe 10, of the present invention enables the user to smoke tobacco out of a sweatshirt, or other article of clothing. It is constructed using high temperature resistant materials, while maintaining the look of a normal sweatshirt. Smoking apparatus 12, is constructed through the drawstring of the sweatshirt. Smoking apparatus 12, is preferably constructed by running high temperature tubing through the drawstring of the hood or the sweatshirt, or other article of clothing. The tubing 26 can be covered with drawstring material, which enables it to look like a conventional sweatshirt. The covering can be made with many different materials, including cotton, polyester, cotton-polyblends, fiberglass, carbon fiber, aramid, and the like. The tubing may be inserted into a covering or can be pre-made with covering. The tubing may be made of silicone, PVC, Tygon or other high temperature resistant tubing. Tubing 26, is connected to a smoking bowl 34, on one end into which the tobacco can be placed. The smoking bowl piece can be constructed out of glass, metal, wood, clay, bone, composite, or other high temperature resistant materials. Smoking bowl piece 34, may be provided in a wide variety of shapes and designs, and is preferably configured to look like a normal part of the sweatshirt 10, however, it may be alternatively be shaped to be noticed and extravagant. The other end of tubing 26, is connected to mouthpiece 30, which may be constructed of the same materials as the smoking bowl piece. Mouthpiece 30, is shaped to conform to the users mouth and can bed made to match the smoking bowl piece in appearance. Alternatively, mouthpiece 30, may be made to look different from smoking bowl piece 34, and both may be provided in various colors and configurations.

Smoking apparatus 12, may be removed from sweatshirt 10, during washing. It can easily be pulled through the aperture 19, in the hood or collar, and can later be reinserted with ease. Smoking apparatus 12, is preferably held in place by stitching 17, running the perimeter of the hood or collar, or otherwise attached using mechanical fasteners, such as clips, clamps, or adhesives, for example. Smoking apparatus 12, is easily adapted and used with many different sweatshirt and jacket designs, or in other articles of clothing. If an article of clothing has any sort of drawstring system, the smoking apparatus 12, can easily be installed and used.

Additional advantages and modification will readily occur to those skilled in the art. The invention in its broader aspects is, therefore, not limited to the specific details, representative apparatus and illustrative examples shown and described. Accordingly, departures from such details may be made without departing from the spirit or scope of the applicant's general inventive concept.

What is claimed is:

1. A hooded sweatshirt comprising: a garment body having a neck opening and sleeves;

a hood, adapted to be worn over and configured to a user's head, coupled with said garment body, said hood having a channel around the perimeter of said hood;

an elongated cord removably positioned inside said channel for tightening said hood and configured to the user's head and neck, wherein said garment body and said hood are composed of a heat resistant, fireproof material capable of withstanding high temperatures; and a hollow tube positioned inside of said elongated cord, said tube having a first and a second end, said first end having a mouthpiece, and said second end having a smoking bowl for retaining smoking material, said mouthpiece in gaseous communication with said smoking bowl via the hollow tube.

2. The hooded sweatshirt of claim 1, wherein said elongated cord is a string composed of cloth.

3. The hooded sweatshirt of claim 1, wherein said mouthpiece is constructed of a heat resistant material.

4. The hooded sweatshirt of claim 1, wherein said smoking bowl is composed of a heat resistant material.

5. The hooded sweatshirt of claim 1, wherein said hollow tube is secured to said mouthpiece by a bonding agent.

6. The hooded sweatshirt of claim 1, wherein said hollow tube is secured to said smoking bowl by a bonding agent.

7. A sweatshirt comprising:

a garment body having a neck opening with a channel, and sleeves, wherein said garment body is composed of a heat resistant, fireproof material capable of withstanding high temperature;

an elongated cord removably positioned within said channel for tightening a portion of said garment body, said elongated cord having a first cord end and a second cord end; and a hollow tube having the same length as said elongated cord and positioned inside said elongated cord such that said hollow tube having a first tube end is aligned with said first cord end and a second tube end is aligned with said second cord end, said first tube end coupling with a mouthpiece, and said second tube end coupling with a smoking bowl for retaining smoking material, said mouth piece in gaseous communication with said smoking bowl via the hollow tube.

8. The sweatshirt of claim 7, wherein said elongated cord is a string composed of cloth.

9. The sweatshirt of claim 7, wherein said mouthpiece is coupled with said hollow tube and said elongated cord and is constructed of a heat resistant material.

10. The sweatshirt of claim 7, wherein said smoking bowl is coupled with said hollow tube and said elongated cord and composed of a heat resistant material.

11. The sweatshirt of claim 7, wherein said hollow tube is secured to said mouthpiece and said smoking bowl by a bonding agent.

12. An article of clothing selected from the group consisting of a sweatshirt and a coat, said article of clothing composed of a heat resistant material, said article of clothing comprising;

a garment body having a neck opening with a passageway and sleeves; an elongated cord removably positioned within said passageway and configured to tighten said clothing around a user's head, neck, or body, said elongated cord having a first cord end and a second cord end; and a tube having the same length as said elongated cord and positioned inside said elongated cord such that said tube having a first tube end that is aligned with said first cord end and a second tube end that is aligned with said second cord end, said first tube end coupling with a mouthpiece, and said second tube end coupling with a smoking bowl for retaining smoking material, said mouthpiece in gaseous communication with said smoking bowl via the tube.

13. The article of clothing of claim 12, wherein said elongated cord is a string composed of cloth.

14. The article of clothing of claim 12, wherein said mouthpiece and said smoking bowl are constructed of a heat resistant material.

15. The article of clothing of claim 12, further comprising a plurality of holding areas each configured to defer heat to said user's fingers, including a first holding area positioned adjacent to said mouthpiece and including a second holding area positioned adjacent to said smoking bowl.

16. A method of making a hooded sweatshirt having a smoking device incorporated as a functional part of the hooded sweatshirt clothing, comprising:

obtaining a hooded sweatshirt that includes:

a garment body having a neck opening and sleeves; and a hood adapted to be worn over and configured to a user's head, coupled with said garment body, said hood having a channel around the perimeter of said hood, wherein said garment body and said hood are composed of a heat resistant, fireproof material capable of withstanding high temperatures;

obtaining an elongated cord for tightening said hood and configured to the user's head and neck;

making a smoking device, including:

positioning a hollow tube inside of said elongated cord, said tube having a first tube end that is aligned with said first cord end and a second tube end that is aligned with said second cord end;

coupling a mouthpiece with said first tube end; and coupling a smoking bowl with said second tube end, said smoking bowl for retaining smoking material such that said mouthpiece is in gaseous communication with said smoking bowl via the hollow tube; and positioning said smoking device thru said channel.

* * * * *